United States Patent [19]

Henthorne et al.

[11] 4,201,575

[45] May 6, 1980

[54] AUSTENITIC STAINLESS CORROSION-RESISTANT ALLOY

[75] Inventors: Michael Henthorne, Los Altos, Calif.; Terry DeBold, Reading, Pa.

[73] Assignee: Carpenter Technology Corporation, Reading, Pa.

[21] Appl. No.: 40,179

[22] Filed: May 18, 1979

[51] Int. Cl.[2] ..... C22C 30/00

[52] U.S. Cl. ..... 75/122; 75/134 C; 75/125; 148/38

[58] Field of Search ..... 75/122, 134 R, 134 C, 75/125; 148/38

[56] References Cited

U.S. PATENT DOCUMENTS

| | | | |
|---|---|---|---|
| 2,777,766 | 1/1957 | Binder | 75/134 R |
| 3,168,397 | 2/1965 | Scharfstein | 75/128 R |

*Primary Examiner*—M. J. Andrews
*Attorney, Agent, or Firm*—Edgar N. Jay

[57] ABSTRACT

An austenitic stainless corrosion resistant alloy consisting essentially in weight percent (w/o) of

| | Broad-(w/o) | Preferred-(w/o) |
|---|---|---|
| C | 0.06 Max. | 0.015–0.025 |
| Mn | 1.00 Max. | 0.50 Max. |
| Si | 0.50 Max. | 0.40 Max. |
| P | 0.03 Max. | 0.03 Max. |
| S | 0.03 Max. | 0.005 Max. |
| Cr | 22–26 | 23.5–24.5 |
| Ni | 32.5–37 | 32.5–34.5 |
| Mo | 5–6.7 | 5.5–6.2 |
| Cu | 1.0–4 | 3.0–3.5 |
| B | 0.005 Max. | 0.0015–0.0035 |
| Nb | 1 Max. | 0.15–0.25 |
| N | 0.4 Max.* | 0.05 Max. |
| Ce + La | 0.4 Max.** | 0.3 Max.** |

*OR the limit of solubility.
**Amount added as misch metal.

The balance is iron and incidental impurities. The alloy is useful for the production of parts requiring good resistance to corrosion. It has good resistance to pitting and stress corrosion when exposed to chlorides and has good resistance to oxidizing media. The alloy is particularly useful as parts for fume scrubbers and in phosphoric acid plants.

19 Claims, No Drawings

AUSTENITIC STAINLESS CORROSION-RESISTANT ALLOY

This invention relates to an austenitic stainless alloy and, more particularly, to an austenitic stainless alloy having a chromium-nickel-iron matrix characterized by a unique combination of chemical and mechanical properties with relatively low cost.

Stainless 20Cb-3 (trademark of Carpenter Technology Corporation, Reading, Pa., the assignee of the present application) alloy is the commercial designation of a stainless alloy disclosed and claimed in the U.S. Pat. No. 3,168,397 granted to L. R. Scharfstein on Feb. 2, 1965. The 20Cb-3 stainless alloy nominally contains 20 weight percent (w/o) chromium, 33.5 w/o nickel, 2.5 w/o molybdenum, 3.5 w/o copper with the balance iron plus small amounts of other elements such as not more than 0.06 w/o carbon, not more than 2 w/o manganese, not more than 1 w/o silicon, not more than 0.03 w/o phosphorus, not more than 0.03 w/o sulfur, niobium plus tantalum in an amount from 8 times the amount of carbon present to not more than 1 w/o. Small amounts of boron, misch metal (primarily cerium plus lanthanum) and nitrogen may also be present. 20Cb-3 stainless alloy has received commercial acceptance in a wide variety of applications because of its good corrosion resistance, mechanical properties and ease of fabrication. Typical uses for the alloy include mixing tanks, heat exchangers, process piping, metal cleaning and pickling tanks, pumps, valves, fittings, fasteners and others. The alloy has also been used in $SO_2$ scrubbers and elsewhere where its pitting and crevice corrosion resistance has left something to be desired.

A more highly alloyed composition such as Hastelloy G alloy (trademark of the Cabot Corporation) disclosed and claimed in U.S. Pat. No. 2,777,766 granted to W. O. Binder on Jan. 15, 1957, has better pitting and crevice corrosion resistance and is the commercial designation of an alloy which nominally contains 22 w/o chromium, 45 w/o nickel, 6.5 w/o molybdenum, 2 w/o copper, 2 w/o niobium plus tantalium, and the balance substantially iron. However, Hastelloy G is significantly more expensive than 20Cb-3 alloy.

BRIEF SUMMARY OF THE INVENTION

It is, therefore, a principal object of this invention to provide an austenitic stainless chromium-nickel-iron alloy having improved pitting and crevice corrosion resistance combined with good mechanical properties and relatively low cost.

The foregoing as well as additional objects and advantages are attained by carefully balancing the composition which consists essentially of the broad and preferred amounts of the elements indicated in Table I, the balance being essentially iron. However, it is to be noted that the preferred amount of one or more elements can be used with the broad amounts of the remaining elements if desired.

TABLE I

| | Broad-(w/o) | Preferred-(w/o) |
|---|---|---|
| C | 0.06 Max. | 0.015–0.025 |
| Mn | 1.00 Max. | 0.50 Max. |
| Si | 0.50 Max. | 0.40 Max. |
| P | 0.03 Max. | 0.03 Max. |
| S | 0.03 Max. | 0.005 Max. |
| Cr | 22–26 | 23.5–24.5 |
| Ni | 32.5–37 | 32.5–34.5 |

TABLE I-continued

| | Broad-(w/o) | Preferred-(w/o) |
|---|---|---|
| Mo | 5–6.7 | 5.5–6.2 |
| Cu | 1.0–4 | 3.0–3.5 |
| B | 0.005 Max. | 0.0015–0.0035 |
| Nb | 1 Max. | 0.15–0.25 |
| N | 0.4 Max.* | 0.05 Max. |
| Ce + La | 0.4 Max.** | 0.3 Max.** |

*Or the limit of solubility.
**Amount added as misch metal.

It is also to be noted that intermediate ranges for each element can be provided by taking its broad minimum or maximum amount with its preferred maximum or minimum amount, respectively.

DETAILED DESCRIPTION

This composition is austenitic, but even though carbon and nitrogen are powerful austenite stabilizers, neither is considered essential in this composition. Because of the cost involved in making such a composition with extremely low carbon, less than about 0.010 w/o, and because a small amount of carbon may have a beneficial effect, 0.015–0.025 w/o is preferably present. Above that amount, particularly with about 0.03–0.06 w/o carbon, a stabilizer such as niobium in an amount of 0.25 w/o up to about 8 times the percent carbon should also be present if undesired carbides are to be minimized following sensitization at about 1250 F (677 C). However, with about 0.35 w/o or more niobium present, when the composition is heated at about 1400 F (760 C), an increased amount of an undesired second phase may be present which may be sigma phase. Therefore, if during preparation or use, the composition will be held at about 1400 F (760 C) for a significant length of time, e.g. more than 5 minutes or about 20 minutes or more, carbon in an amount above about 0.03 w/o and the accompanying niobium are to be avoided.

When the composition is not to be exposed in use to highly oxidizing media such as hot nitric acid then larger amounts of niobium up to about 1 w/o can be present. It is also advantageous to adjust the balance of the composition by combining the lower levels of molybdenum with the higher levels of niobium, that is with about 5 w/o molybdenum up to about 0.5 w/o niobium can be used even when the composition may in use be subjected to 1400 F and exposure to highly oxidizing media. For this purpose, it is contemplated the larger amounts of nickel, that is 36 w/o and 37 w/o may be balanced with the larger amounts of niobium. Thus balancing the larger amounts of an austenite former such as nickel and the larger amounts of an element like chromium which affords resistance to oxidizing media would permit either or both such ferrite formers as molybdenum and niobium to be present in larger amounts than is otherwise preferred.

The objectionable effect of a second phase such as sigma caused by ferrite-forming elements may be avoided by the presence of up to about 0.2 w/o nitrogen. Because of its beneficial effect in stabilizing the austenitic field in this composition, it is also contemplated that nitrogen in excess of 0.05 w/o can be used, up to about 0.4 w/o, so long as the amount that can be retained in solid solution is not exceeded. However, nitrogen in amounts greater than about 0.1 w/o detracts from, and greater than about 0.2 w/o severely impairs, the forgeability of the composition. Thus, the larger amounts of nitrogen give best results when providing castings or when powder metallurgy techniques are used.

Because of their undesired effect upon the corrosion resistance or forgeability of this composition, manganese, silicon, phosphorus and sulfur are kept low as indicated in Table I. Commercial grades of niobium-bearing additions include some tantalum. Therefore, the percent stated for niobium is intended to include the amount of niobium plus tantalum usually found together.

Up to about 0.005 w/o boron, preferably 0.001 w/o or better yet 0.0015–0.0035 w/o, boron is believed to have a beneficial effect on the corrosion resistance and to some extent on the forgeability of the composition and may be included for those purposes. Misch metal (a mixture of rare earths primarily comprising cerium and lanthanum) may also have a beneficial effect upon the composition's forgeability, but for that effect no definite amount of misch metal need be retained in the composition, and, preferably, there is none; its beneficial effect being provided during the melting process when, if used, up to about 0.4 w/o, preferably no more than about 0.3 w/o, may be added if desired.

In this composition, the elements chromium, nickel, molybdenum and copper must be carefully balanced within the stated ranges if the composition is to have the desired properties, in particular improved resistance to pitting and crevice corrosion resistance. Chromium in the amount of 22–26 w/o is present in this composition because of its beneficial effect on intergranular corrosion resistance as measured by the boiling 65 w/o nitric acid test (ASTM A262-C) and by the ferric sulfate-sulfuric acid test (ASTM A262-B). Chromium also contributes pitting resistance as measured in ferric chloride (ASTM G-48). However, chromium in excess of about 26 w/o is believed to contribute to the formation of undesired second phases and is preferably limited to no more than 24.5 w/o. Below 22 w/o chromium, the desired corrosion resistance of this composition is not attainable with the maximum amounts of 6.7 w/o molybdenum tolerable in this composition. Best results are attained with 23.5–24.5 w/o chromium.

Molybdenum contributes to the pitting and crevice corrosion resistance of this composition, and, for this purpose, a minimum of 5 w/o and better yet 5.2 w/o is present. Preferably, at least 5.5 w/o is used. Increasing molybdenum adversely affects the intergranular corrosion resistance of this composition as measured in boiling nitric acid and, for that reason, no more than 6.7 w/o, preferably no more than 6.2 w/o, molybdenum should be present.

Because of the adverse effect of the larger amounts of molybdenum, that is greater than about 6 w/o or from 6.2 to 6.7 w/o, on intergranular corrosion resistance those amounts of molybdenum should be balanced with the larger amounts of chromium, that is greater than 24 w/o or from 24.5 to 26 w/o, if the composition after sensitization at about 1400 F (760 C) is to be exposed to an oxidizing medium such as hot nitric acid. For such exposure, the smaller amounts of both chromium and molybdenum that is less than 23.5 w/o chromium and less than 5.5 w/o molybdenum within the broad ranges of Table I, can also be used together. On the other hand, when pitting and crevice corrosion resistance in media such as ferric chloride is a primary concern then the larger amounts of molybdenum provide good results when balanced with the smaller amounts of chromium contemplated herein and it is preferred to avoid using in the same composition the maximum amounts of chromium and molybdenum contemplated herein when cooling through the critical temperature range cannot be rapid enough to prevent sensitization.

Copper is also believed to contribute to the corrosion resistance of this composition, particularly in sulfuric acid and, like nickel, works to stabilize the austenitic balance of this composition. For that purpose, 1–4 w/o copper can be used but the amount present must not exceed the amount which can be retained in solid solution. Preferably, 3–3.5 w/o copper is present in this composition.

Nickel ensures the austenitic balance of this composition and its desired properties, particularly corrosion resistance. For those reasons 32.5–37 w/o nickel can be used. Above 37 w/o nickel adds to the cost of the alloy without correspondingly contributing to its usefullness thereby making the added cost unwarranted. Preferably no more than about 34.5 w/o nickel is present.

This composition is melted, cast and worked using well known metallurgical techniques. When forging is to be carried out it is preferably done from a furnace temperature of 2250 F (1232 C). Annealing is preferably carried out at a relatively high temperature, that is above about 2050 F (1121 C) and better yet at about 2100 F to 2150 F (1148–1177 C). Annealing at lower temperatures, e.g. such as annealing at about 1750 F (955 C) to stabilize carbon is to be avoided because it tends to leave harmful amounts of a second phase believed to be sigma phase. This composition lends itself to the formation of a wide range of shapes and products such as billets, bars, rod, strip or sheet. Forming and shaping can be carried out using conventional practices. In the case of welded products best corrosion resistance, particularly pitting resistance, is maintained by using as weld filler material Hastelloy G alloy or Inconel 625 alloy, preferably the latter.

The examples set forth in Table II contain varying amounts of chromium, molybdenum, carbon and niobium and are illustrative of alloys balanced within the board and preferred ranges for those elements in accordance with the present invention.

TABLE II

| Ex. No. | C | Cr | Ni | Mo | Cu | Nb |
|---|---|---|---|---|---|---|
| 1 | .02 | 23.97 | 33.51 | 6.03 | 3.39 | .03 |
| 2 | .02 | 23.92 | 33.53 | 6.00 | 3.39 | .23 |
| 3 | .02 | 24.01 | 33.51 | 6.01 | 3.37 | .38 |
| 4 | .02 | 23.97 | 33.45 | 6.00 | 3.38 | .53 |
| 5 | .03 | 23.91 | 33.04 | 5.92 | 3.33 | .01 |
| 6 | .03 | 23.93 | 33.13 | 5.97 | 3.33 | <.01 |
| 7 | .02 | 22.83 | 33.16 | 4.92 | 3.36 | .55 |
| 8 | .02 | 23.03 | 33.18 | 5.39 | 3.34 | .55 |
| 9 | .02 | 25.43 | 33.21 | 5.59 | 3.32 | .57 |
| 10 | .02 | 23.03 | 33.19 | 6.65 | 3.35 | .56 |
| 11 | .02 | 25.60 | 33.26 | 6.64 | 3.31 | .56 |
| 12 | .02 | 22.70 | 32.77 | 5.92 | 3.33 | .52 |
| 13 | .02 | 25.57 | 32.95 | 6.03 | 3.33 | .54 |
| 14 | .02 | 25.36 | 33.28 | 5.20 | 3.34 | .56 |
| 15 | .02 | 23.18 | 33.51 | 6.34 | 3.36 | .55 |

In Examples 1–15 manganese and silicon each ranged between 0.30 and 0.40 w/o, phosphorus was less than 0.030 w/o, sulfur was less than 0.010 w/o, boron ranged from 0.002 to 0.0032, the amount of cerium plus lanthanum present was 0.015 w/o or less except for example 15 which contained 0.03 w/o, nitrogen did not exceed 0.040 w/o, and the balance was iron except for small amounts, up to several hundredths of a percent, of incidental impurities.

Each of the Examples 1–15 was prepared from small experimental heats and cast under an inert atmosphere as an ingot weighing about 8 lb (3.63 kg). Forging and hot rolling to 0.250 in (0.64 cm) strip were carried out from a temperature of from 2050–2100 F (1121–1149 C). The strip was then annealed at 2100–2150 F (1149–1177 C) for 45 minutes, water quenched and then cold rolled to 0.125 in (0.32 cm) strip. The cold rolled strip was annealed and then formed into test specimens in keeping with the appropriate ASTM test specification. Unless otherwise indicated, the cold rolled material from Examples 1–6 was annealed in salt for 5 minutes at 2100 F (1149 C) and air cooled, and the material from Examples 7–15 was annealed in an air atmosphere for 10 minutes at 2125 F (1163 C) and air cooled. Duplicate annealed test specimens at Examples 1–15 were prepared, heated at 1400 F (760 C) for 5 minutes (heat treatment No. 1) or 20 minutes (heat treatment No. 2) and then tested in boiling 65 w/o $HNO_3$ in accordance with ASTM A262-C. The results in mils per year (mpy) and millimeters per year (mmpy) are given in Table III as the values obtained by averaging the results of exposure for 5 successive 48 hour periods unless otherwise indicated.

TABLE III

| Ex. No. | H. T.* | mpy | (mmpy) |
|---|---|---|---|
| 1 | 1 | 7/7 | (.18/.18) |
| | 2 | 11/16 | (.28/.41) |
| 2 | 1 | 7/7 | (.18/.18) |
| | 2 | 15/15 | (.38/.38) |
| 3 | 1 | 8/8 | (.20/.20) |
| | 2 | 240/292** | (6.1/7.42)** |
| 4 | 1 | 7/7 | (.18/.18) |
| | 2 | 277/299** | (7.04/7.59)** |
| 5 | 2 | 18/19 | (.46/.48) |
| 6 | 2 | 34/34 | (.86/1.12) |
| 7 | 1 | 12.4/12.1 | (.315/.307) |
| 8 | 1 | 18.4/18.9 | (.467/.480) |
| 9 | 1 | 10.7/11.4 | (.272/.290) |
| 10 | 1 | 64.0/54.8 | (1.626/1.392) |
| 11 | 1 | 16.4/19.2 | (.417/.488) |
| 12 | 1 | 33.4/— | (.848/—) |
| 13 | 1 | 14.2/13.5 | (.361/.343) |
| 14 | 1 | 20.4/19.4 | (.518/.493) |
| 15 | 1 | 75.2/179.1 | (1.910/4.549) |

*Heat Treatment
1 - 1400° F. (760° C.), 5 minutes, Air Cooled.
2 - 1400° F. (760° C.), 20 minutes, Air Cooled.
**Averages of three 48 hour periods.

From Table III it is apparent that the alloy of the present invention withstands exposure to strongly oxidizing media, such as nitric acid, after exposure to 1400 F (760 C) unless held at that temperature significantly longer than 5 minutes, e.g. about 20 minutes. It is also believed demonstrated that when the longer exposures at temperatures which are high enough to cause the formation of undesired phases but not high enough to cause resolutioning are to be encountered in the fabrication or use of parts, then no more than about 0.03 w/o carbon should be present, niobium should be less than about 0.35 w/o. Examples 10 and 15 demonstrate the effect of using the larger amounts of molybdenum contemplated herein with the lower amounts of chromium. Thus, it is preferred that the larger amounts of molybdenum herein be used with the larger amounts of chromium.

Further intergranular corrosion resistance rates from exposure to 65 w/o boiling nitric acid were determined in accordance with ASTM A262-C on specimens in the form of weldments of Examples 1–6. While all gave satisfactory results when tested in the as-welded condition, the welded specimens of Examples 5 and 6 suffered severe attack when tested following heat treatment at 1250 F (677 C) for 2.5 hours. On the other hand, similarly heat treated welded specimens of Examples 1–4 showed only slight or moderate attack. The test data from welded specimens following various heat treatments are set forth in Table IV as the average of five 48 hour periods unless indicated otherwise.

TABLE IV

| Ex. No. | H. T.* | Corrosion Rate | (mpy(mmpy) |
|---|---|---|---|
| 1 | W | 7/7 | (.18/.18) |
| | 3 | 10/36 | (.25/.91) |
| | 4 | 7/7 | (.18/.18) |
| | 5 | 7/7 | (.18/.18) |
| 2 | W | 7/7 | (.18/.18) |
| | 3 | 9/10 | (.23/.25) |
| | 4 | 7/7 | (.18/.18) |
| | 5 | 6/6 | (.15/.15) |
| 3 | W | 8/8 | (.20/.20) |
| | 3 | 11/12 | (.28/.30) |
| | 4 | 7/7 | (.18/.18) |
| | 5 | 7/7 | (.18/.18) |
| 4 | W | 8/8 | (.20/.20) |
| | 3 | 12/16 | (.30/.41) |
| | 4 | 7/7 | (.18/.18) |
| | 5 | 7/7 | (.18/.18) |
| 5 | W | 9/9 | (.23/.23) |
| | 3 | 883/991** | (22.43/25.17)** |
| 6 | W | 9/9 | (.23/.23) |
| | 3 | 554/588** | (14.07/14.94)** |

*Heat Treatment
W - as welded
3 - welded, 1250 F. (677 C.) 2.5 hrs., air cooled
4 - welded, 2100 F. (1149 C.) 5 min., air cooled
5 - welded, 2100 F. 5 min., air cooled, 1250 F. (677 C.) 1 hr., air cooled
**Averages of three 48 hour periods.

Duplicate test specimens (no crevice) of Examples 1–4 were prepared as described hereinabove and tested in accordance with ASTM G-48 in $FeCl_3$ at 50 C for 3 days. The weight loss of each of the duplicate specimens in grams (g) is given in Table V as well as the condition of the tested specimen as observed with the unaided eye.

TABLE V

| Ex. No. | Weight Loss (g) | |
|---|---|---|
| 1 | .0000/.0001 | (no pits) |
| 2 | .0561/.0894 | (3–5 small pits) |
| 3 | .0000/.0000 | (no pits) |
| 4 | .0001/.0037 | (1 sample-2 small pits) |

The results from the tests in $FeCl_3$ set forth in Table V demonstrate that increasing niobium had no effect on pitting resistance, the larger weight loss of Example 2 being believed to be a typical and not the result of its composition.

Crevice corrosion specimens of Examples 7–10 and 12–14, in duplicate, were prepared and tested in 6 w/o ferric chloride in accordance with ASTM G-48 crevice test, which procedure calls for the formation of crevices by two 0.5 inch (1.27 cm) round cylinders formed from polytetrafluoroethylene and attached by two crossed rubber bands to the large flat faces of each specimen. The weight loss in grams after exposure at room temperature for 3 days is given in Table VI. For convenience, the chromium and molybdenum content is also indicated.

TABLE VI

| Ex. No. | Cr | Mo | Weight Loss (g) |
|---|---|---|---|
| 7 | 22.83 | 4.92 | .0352/.0446 |

TABLE VI-continued

| Ex. No. | Cr | Mo | Weight Loss (g) |
|---|---|---|---|
| 8 | 23.03 | 5.39 | .0153/.0182 |
| 9 | 25.43 | 5.59 | .0002/— |
| 10 | 23.03 | 6.65 | .0001/.0001 |
| 12 | 22.70 | 5.92 | .0000/.0150 |
| 13 | 25.57 | 6.03 | .0003/.0021 |
| 14 | 25.36 | 5.20 | .0000/.0049 |

For crevice corrosion resistance as measured in the 6 w/o ferric chloride crevice test, as little as about 5 w/o molybdenum with about 25 w/o chromium, gives good results, while at the lower chromium levels of about 22–23 w/o the larger amounts of molybdenum, about 6 w/o, are preferred.

Duplicate test specimens of Examples 1–4 heat treated as indicated in connection with both Tables III and IV, and exposed to ferric sulfate—sulfuric acid in keeping with ASTM A262-B had a corrosion rate average of 9 or 10 mpy (0.02 or 0.025 mmpy) when subjected to heat treatment No. 1 or as welded, a corrosion rate ranging from 10 to 16 mpy (0.025 to 0.41 mmpy) or an average of 11.4 mpy (0.290 mmpy) when subjected to heat treatments 3, 4 and 5, and a corrosion rate of about 9 mpy (0.23 mmpy) when tested after being heated at 1250 F (760 C) one hour and air cooled.

As a further illustration of the composition of this invention an arc heat having the composition of Example 16 was prepared and cast into ingots. Material from one 19 inch ingot was hot worked and then cold rolled to strip having finish thicknesses of 0.083 in (0.21 cm) and 0.128 in (0.33 cm) and hot rolled to strip having a finish thickness of 0.195 in (0.50 cm). All of the thus formed strip was annealed at 2100 F (1149 C). The composition of Example 16 and, for comparison, Alloys A and B are set forth in Table VII, the balance of each is iron and incidental impurities. Alloys A and B are representative of alloys 20 Cb-3 and Hastelloy G respectively.

TABLE VII

| | Ex. 16 | Alloy A | Alloy B |
|---|---|---|---|
| C | .025 | .02 | .05 |
| Mn | .40 | .25 | 1.47 |
| Si | .26 | .36 | .48 |
| P | .026 | .018 | .012 |
| S | .004 | .002 | .001 |
| Cr | 24.22 | 19.70 | 21.95 |
| Ni | 33.06 | 33.16 | 43.55 |
| Mo | 5.65 | 2.20 | 6.83 |
| Cu | 3.28 | 3.26 | 2.03 |
| Nb | .21 | .47 | 2.18 |
| B | .003 | .002 | .004 |
| N | .02 | — | .038 |

Pitting and crevice corrosion test specimens were prepared from annealed strip or plate and tested in 6 w/o ferric chloride in keeping with ASTM G-48 and the weight loss in grams were set forth in Table VIII.

TABLE VIII

| | Pitting Test 50 C. | Crevice Test | |
|---|---|---|---|
| | (No Crevice) | 50 C. | 21 C. |
| Ex. 16 (.083 in) | .0007/.0007 | 1.1151/1.1072 | .0050/.0038 |
| Ex. 16 (.195 in) | .0009/.0003 | .9493/.9193 | .0073/.0031 |
| Alloy A(.125 in) | 1.4805/1.5622 | 1.4766/1.5264 | .6237/.5183 |
| Alloy B(.250 in) | .0001/.0008 | .4750/.5157 | .0166/.0002 |

From Table VIII it is apparent that both sets of specimens of Example 16 were equivalent to each other and both were better than Alloy A and either similar to or inferior to Alloy B but not to the extent to be expected from the differences in composition.

Duplicate room temperature strip tensile specimens were prepared from each of the 3 thicknesses of the strip formed from Example 16. The results of the room temperature tensile tests are given in Table IX as the average of the duplicate tests.

TABLE IX

| | 0.2% Y.S. | | UTS | | | |
|---|---|---|---|---|---|---|
| Strip Thickness | ksi | (MPa) | ksi | (MPa) | % El | % RA |
| .083 in (.21 cm) | 37.3 | (257.2) | 88.3 | (608.8) | 47.4 | 71.3 |
| .128 in (.33 cm) | 46.1 | (317.8) | 89.6 | (617.8) | 47.5 | 76.4 |
| .195 in (.50 cm) | 37.5 | (258.6) | 86.8 | (598.5) | 49.6 | 71.5 |

The alloy of the present invention is characterized by a unique combination of resistance to corrosive media, mechanical properties and relatively low expense. In particular the alloy has good resistance to pitting and stress corrosion cracking in chlorides combined with resistance to oxidizing media. Parts formed from this composition are particularly suited for use in $SO_2$ or fume scrubbers and in phosphoric acid plants.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An austenitic stainless corrosion resistant alloy having good resistance to pitting and crevice corrosion in chloride bearing media combined with resistance to corrosion in oxidizing media consisting essentially in weight percent of about

| | |
|---|---|
| C | 0.06 Max. |
| Mn | 1.00 Max. |
| Si | 0.50 Max. |
| P | 0.03 Max. |
| S | 0.03 Max. |
| Cr | 22–26 |
| Ni | 32.5–37 |
| Mo | 5–6.7 |
| Cu | 1.0–4 |
| B | 0.005 Max. |
| Nb | 1 Max. |
| N | 0.4 Max. |
| Ce + La | 0.4 Max. |

the amount of nitrogen being not greater than that which can be retained in solution, the amount of cerium plus lanthanum being the amount added as misch metal, and the balance essentially iron.

2. The alloy set forth in claim 1 which contains a maximum of 0.03 w/o carbon, and a maximum of 0.35 w/o niobium.

3. The alloy set forth in claim 1 which contains about 0.015–0.025 w/o carbon and 0.15–0.25 w/o niobium.

4. The alloy set forth in claim 1 which contains about 3.0–3.5 w/o copper.

5. The alloy set forth in claim 1 which contains 0.001–0.0035 w/o boron, and no more than 0.05 w/o nitrogen.

6. The alloy set forth in claims 1, 2, 3, 4, or 5 which contains at least 5.2 w/o molybdenum.

7. The alloy set forth in claim 2 which contains more than 24 w/o chromium, and more than 6 w/o molybdenum.

8. The alloy set forth in claims 2 or 3 which contains no more than 23.5 w/o chromium, and no more than 5.5 w/o molybdenum.

9. The alloy set forth in claim 1 which contains about 23.5–24.5 w/o chromium, and 5.5–6.2 w/o molybdenum.

10. The alloy set forth in claim 3 which contains about 23.5–24.5 w/o chromium, and about 5.5–6.2 w/o molybdenum.

11. The alloy set forth in claims 9 or 10 which contains about 32.5–34.5 w/o nickel, and about 3.0–3.5 w/o copper.

12. The alloy set forth in claims 9 or 10 which contains no more than about 0.0035 w/o boron and no more than about 0.05 w/o nitrogen.

13. The alloy set forth in claim 12 which contains at least about 0.0015 w/o boron.

14. The alloy set forth in claim 12 which contains no more than about 0.50 w/o manganese, no more than about 0.40 w/o silicon, and no more than about 0.03 w/o phosphorus.

15. The alloy set forth in claim 14 which contains no more than about 0.005 w/o sulfur.

16. The alloy set forth in claim 6 which contains no more than about 0.005 w/o sulfur.

17. The alloy set forth in claims 9 or 10 which contains no more than about 0.005 w/o sulfur.

18. A corrosion resistant austenitic stainless article having good resistance to pitting and crevice corrosion in chloride bearing media combined with resistance to corrosion in oxidizing media and having the composition of an austenitic stainless alloy which in weight percent consists essentially of about

| | |
|---|---|
| C | 0.06 Max. |
| Mn | 1.00 Max. |
| Si | 0.50 Max. |
| P | 0.03 Max. |
| S | 0.03 Max. |
| Cr | 22–26 |
| Ni | 32.5–37 |
| Mo | 5–6.7 |
| Cu | 1.0–4 |
| B | 0.005 Max. |
| Nb | 1 Max. |
| N | 0.4 Max. |
| Ce + La | 0.4 Max. |

the amount of nitrogen being not greater than that which can be retained in solution, the amount of cerium plus lanthanum being the amount added as misch metal, the balance essentially iron, and annealed at a temperature high enough above 955 C to minimize the formation of harmful secondary phases.

19. The article set forth in claim 18 in wrought form which consists essentially in weight percent of about

| | |
|---|---|
| C | 0.015–0.025 |
| Mn | 0.50 Max. |
| Si | 0.40 Max. |
| P | 0.03 Max. |
| S | 0.005 Max. |
| Cr | 23.5–24.5 |
| Ni | 32.5–34.5 |
| Mo | 5.5–6.2 |
| Cu | 3.0–3.5 |
| B | 0.0015–0.0035 |
| Nb | .15–0.25 |
| N | 0.05 Max. |
| Ce + La | 0.3 Max. |

* * * * *

UNITED STATES PATENT OFFICE

CERTIFICATE OF CORRECTION

PATENT NO. : 4,201,575

DATED : May 6, 1980

INVENTOR(S) : Michael Henthorne and Terry DeBold

It is certified that error appears in the above-identified patent and that said Letters Patent are hereby corrected as shown below:

Col. 1, line 42, correct spelling of "tantalum".

Col. 4, line 17, correct spelling of "usefulness";

line 41, for "board" read -- broad --.

Col. 5, line 16, for "at" read -- of --;

Table III, Ex. 6, under heading "mpy" for "34/34" read -- 34/44 --.

Col. 6, line 52, for "a typical" read -- atypical --.

Col. 7, line 26, for "(760 C)" read -- (677 C) --;

line 57, for "were" read -- are --;

Signed and Sealed this

*Sixteenth* Day of *September 1980*

[SEAL]

*Attest:*

SIDNEY A. DIAMOND

*Attesting Officer*

*Commissioner of Patents and Trademarks*